United States Patent [19]

Soennichsen

[11] Patent Number: 4,498,949

[45] Date of Patent: Feb. 12, 1985

[54] SPLICING APPARATUS FOR CROSS-FLUTE CORRUGATED BOARD

[76] Inventor: Rolf Soennichsen, Hamburg, Fed. Rep. of Germany

[21] Appl. No.: 418,715

[22] Filed: Sep. 16, 1982 (Under 37 CFR 1.47)

[30] Foreign Application Priority Data

Oct. 29, 1981 [DE] Fed. Rep. of Germany ..... 3142832

[51] Int. Cl.[3] ..... B31F 1/20

[52] U.S. Cl. ..... 156/462; 156/159; 156/205; 156/207; 156/210; 156/266; 156/285; 156/292; 156/467; 156/470; 156/494; 156/512; 156/558; 156/566; 226/197; 271/99; 271/132

[58] Field of Search ..... 156/207, 182, 205, 210, 156/229, 264, 266, 292, 304.2, 462, 470, 494, 502, 512, 554, 558, 559, 572, 467, 497, 566, 285, 157, 159; 226/197; 271/99, 102, 132

[56] References Cited

U.S. PATENT DOCUMENTS

| | | | |
|---|---|---|---|
| 2,331,533 | 10/1943 | Bishop | 271/99 |
| 2,715,975 | 8/1955 | Doane et al. | 156/566 |
| 4,025,384 | 5/1977 | Shiozaki et al. | 156/159 |
| 4,043,495 | 8/1977 | Sander | 226/197 |
| 4,126,508 | 11/1978 | Hoelzinger | 156/512 |
| 4,128,677 | 12/1978 | Hoelzinger | 156/210 |
| 4,288,273 | 9/1981 | Butler, Jr. et al. | 156/494 |

FOREIGN PATENT DOCUMENTS

| | | |
|---|---|---|
| 1304738 | 1/1973 | United Kingdom . |
| 1482387 | 8/1977 | United Kingdom . |

*Primary Examiner*—Jay H. Woo
*Assistant Examiner*—Timothy W. Heitbrink
*Attorney, Agent, or Firm*—Laubscher, Philpitt & Laubscher

[57] ABSTRACT

Apparatus is disclosed for splicing together successive sections of single facer corrugated board having planar and corrugated fibrous layers, which sections are initially conveyed colinearly in spaced relation at uniform speed with the flutes extending in the direction of travel of the sections, characterized by the provision of a reciprocatory vacuum bar feed member operable initially to accelerate a subsequent section relative to a preceding section to a position in which a protruding layer portion at the trailing end of the preceding section is in superposed relation relative to a protruding layer portion at the leading end of the subsequent section, and subsequently to displace the section at the lower uniform speed at the moment at which the adjacent ends of the sections are in overlapping relation, whereupon the superposed portions may be bonded together to connect the sections to form a continuous web having longitudinally extending flutes. The vacuum bar feed member has a profiled upper surface containing grooves for receiving the corrugations of the subsequent section, which grooves are evacuated to maintain the section, by suction, in engagement with the vacuum bar feed member.

22 Claims, 21 Drawing Figures

EDGE GUIDE MEANS (FIG. 19)
68
30
52
50
70
74
2'
2a
2b'
4
5
6

Fig. 7
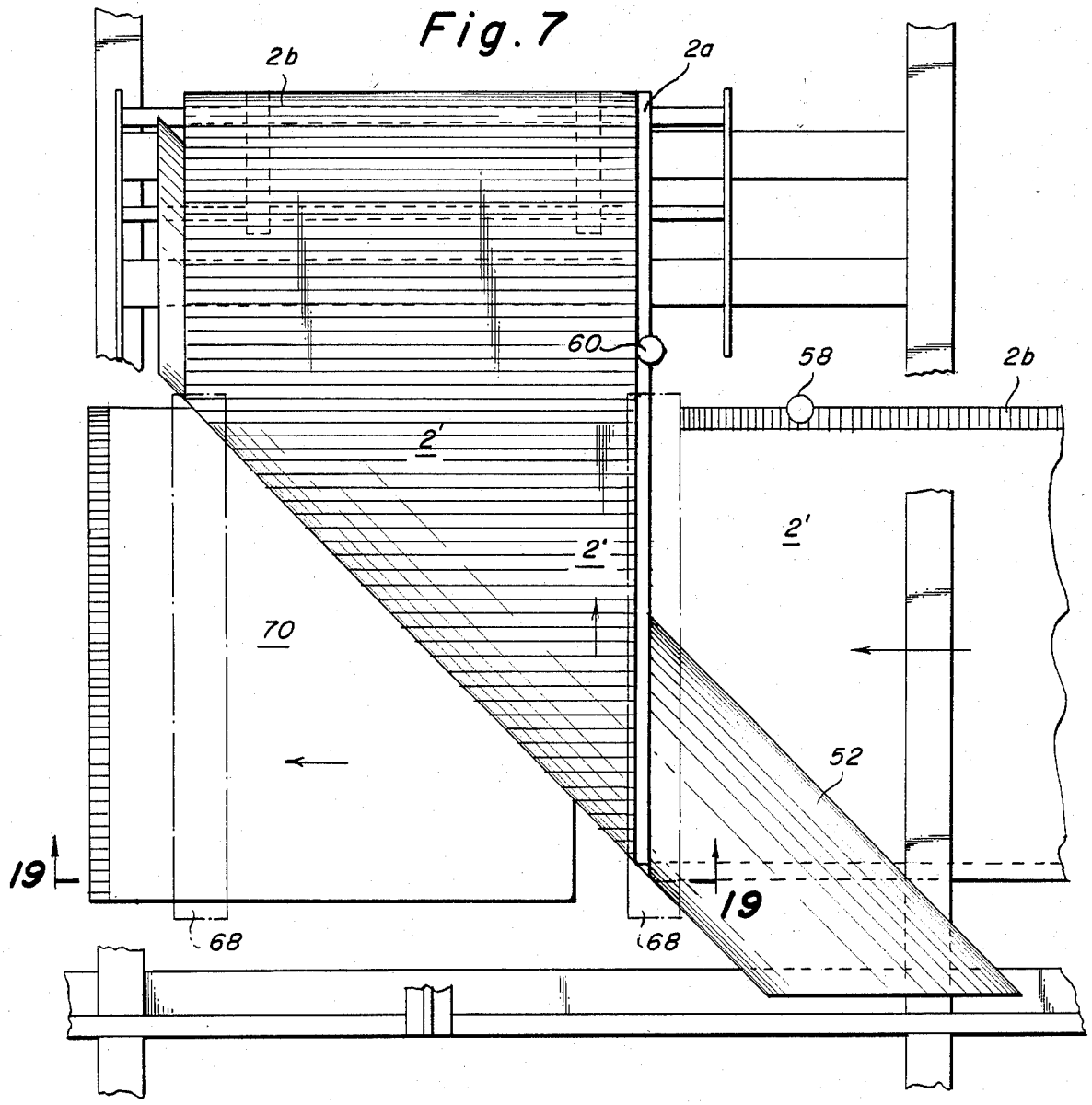
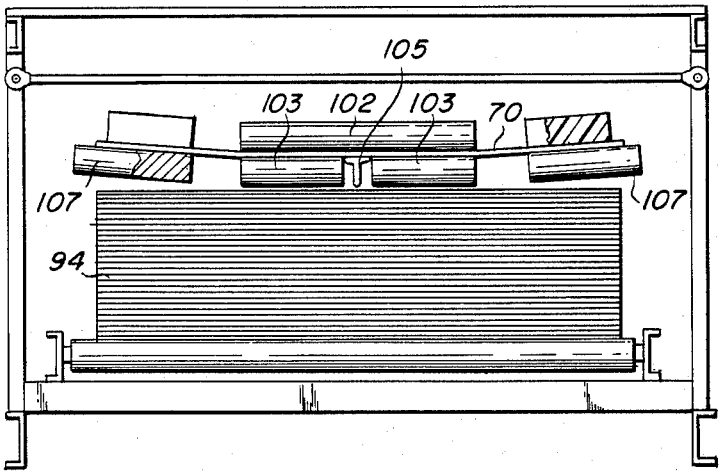
Fig. 10

Vacuum Control Means
Variable Resistance
TO CUTTERS
36
38
40
42
161
70
100
102
103
101
112
115
95
120
114
121
14
140
142
148
150
2
160

SPLICING APPARATUS FOR CROSS-FLUTE CORRUGATED BOARD

BRIEF DESCRIPTION OF THE PRIOR ART

In the prior Hoelzinger U.S. Pat. Nos. 4,126,508, 4,128,677 and 4,435,237 apparatus is disclosed for splicing together severed sections of single-facer corrugated board in such a manner as to form a continuous web the flutes of which extend longitudinally of the web (rather than in the conventional transverse direction). Rotary hopper means are provided for rotating a stack of the severed sections about its vertical axis through an angle of 90°, whereby the flutes of the sections of the rotated stack extend longitudinally of the apparatus, thereby to permit successive longitudinal feeding of the sections toward the splicing station.

One drawback of the known apparatus is the difficulty in introducing successive sections within the upper portion of the hopper means, in transferring the sections from one portion of the hopper means to another, and in removing successive rotated sections from the bottom of the hopper means. Furthermore, owing to the mass of the rotatable portion of the hopper means, it is difficult to accurately rotate the hopper section within the time constraints of an "in-line" corrugator installation.

Another problem inherent in the prior apparatus is the difficulty in accurately guiding and accelerating a subsequent section toward a desired bonding position relative to the trailing end of a preceding section. In the prior apparatus, a reciprocatory kicker member engaged the trailing end of the subsequent section and forceably pushed the same forwardly toward the preceding section, whereby it is difficult to align the corrugations of the sections relative to each other, and to effect the desired corrugation-engaging bonding operation.

The present invention was developed to avoid the above and other drawbacks of the known apparatus. CL

SUMMARY OF THE INVENTION

Accordingly, a primary object of the present invention is to provide improved splicer means for bonding together a pair of single facer sections having longitudinally extending flutes, characterized by the provision of vacuum bar feed means for accurately guiding and accelerating a second section relative to a first section to a position in which a protruding layer portion at the trailing end of the first section is in superposed relation relative to the projecting layer portion at the leading edge of the second section, which vacuum bar means includes a profiled surface having grooves for receiving the corrugations of the corrugated layer, and vacuum means for evacuating the grooves to maintain, by suction, the second section in engagement with vacuum bar means. Drive means are provided for accelerating the vacuum bar means in the direction of the first section and to position the second section carried thereby in the desired bonding relation relative to the first section.

In accordance with another object of the invention, the sections are severed from a first single facer web after the web is progressively turned through an angle of 90° during passage around an angularly arranged turning member, whereby the flutes of the severed section extend longitudinally in a direction parallel with the initial direction of travel of the first web. The sections, which are preferably severed from the first web subsequent to the application of the bonding glue to the protruding layer portions at the edges thereof, are transported in an overlapping shingled manner toward a stacking station, whereupon successive sections are removed from the stack formed at the stacking station and are transported to the vacuum bar feed means arranged adjacent the splicer means.

According to a more specific object of the invention, the vacuum bar feed means includes a plurality of groups of chambers that are arranged horizontally in a direction normal to the axis of travel of successive sections. Some of the chambers extend forwardly beyond the other chambers in the direction of the splicer roll means, whereby the section may be accurately oriented and supported at the instant of introduction of the splicer means, thereby to assure the proper interengagement between the corrugations at the forward end of the second section and the corrugations at the rearward end of the preceding section.

According to a further object of the invention, drive means are provided for accelerating the vacuum bar feed means to displace the second section transported thereby toward the desired splicing position relative to the preceding section.

A further object of the invention is to provide guide means for guiding and supporting severed sections during the displacement thereof from the section severing station toward the path of feed of successive sections to the section splicing station.

BRIEF DESCRIPTION OF THE DRAWING

Other objects and advantages of the invention will become apparent from a study of the following specification when viewed in the light of the accompanying sheets of drawing, in which:

FIG. 7 is a top plan view of the 90° turning and section severing station of FIGS. 3 and 6;

FIG. 10 is a sectional view taken along line 10—10 of FIG. 9;

DETAILED DESCRIPTION

Figure 1:
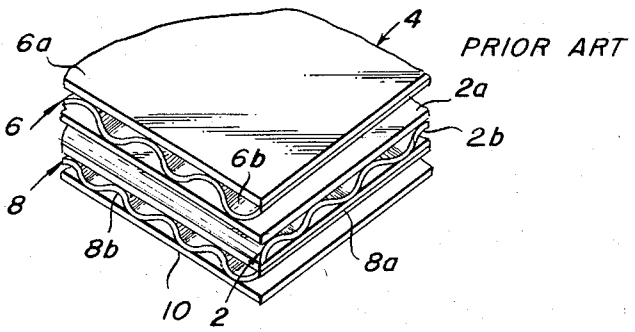
FIG. 1 is a detailed perspective view of the known cross-flute corrugated product of the prior art.

The method and apparatus of the present invention are directed to the production of a continuous single facer web 2 having planar and corrugated fibrous layers 2*a* and 2*b*, respectively, the flutes of the corrugated layer extending longitudinally of the web. This web 2 is particularly suitable for use as the central laminate portion of a fibrous cross-fluted corrugated laminate 4 including, in succession, an upper web 6 having a planar top layer 6*a* and a corrugated layer 6*b* with laterally extending flutes, the central web 2 with longitudinally extending flutes, a bottom single facer web 8 including a planar layer 8*a* and a corrugated layer 8*b* with laterally extending flutes, and a bottom planar layer 10.

Figure 2:
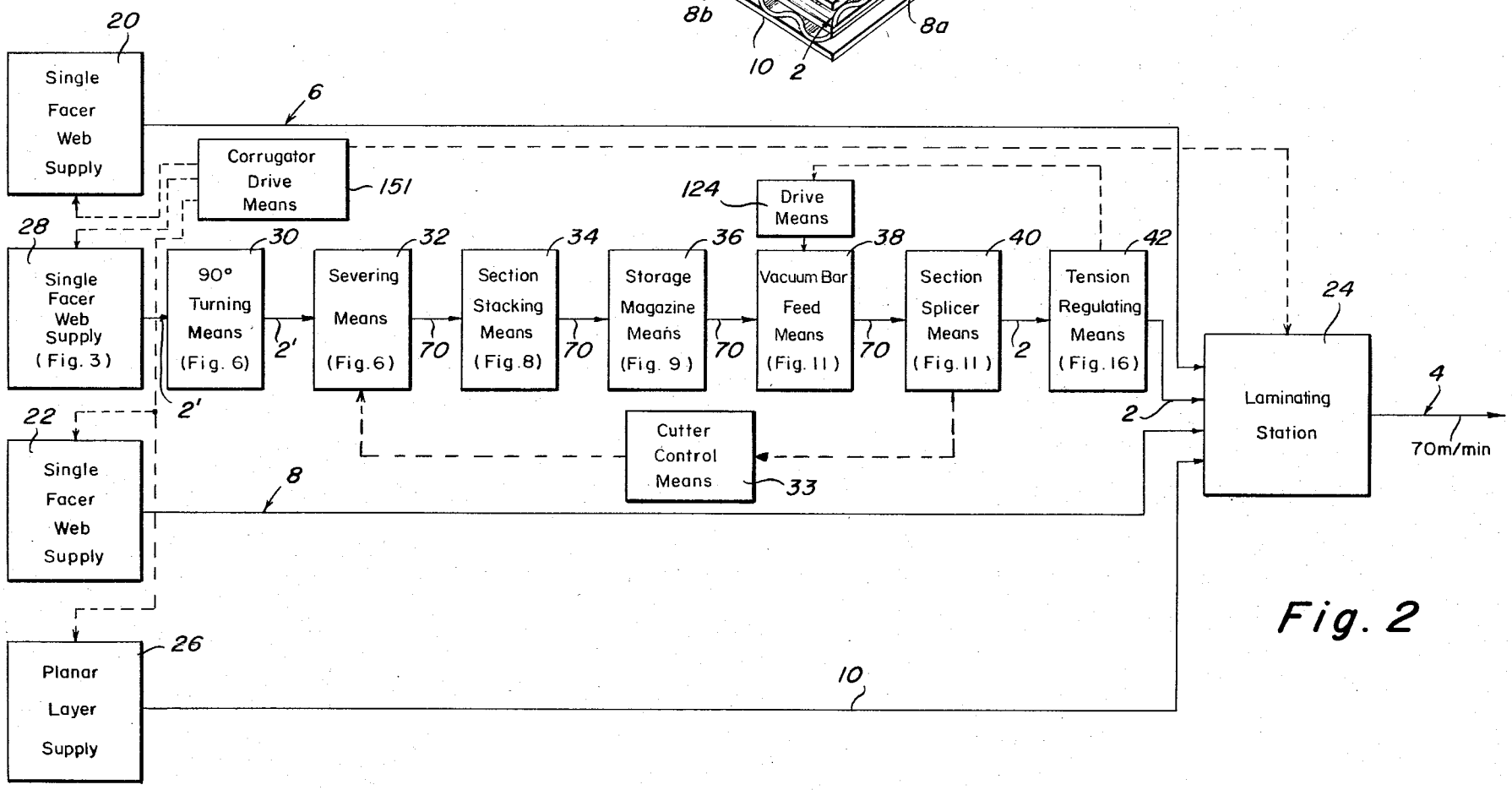
FIG. 2 is a block diagram of the apparatus for forming a continuous web laminate including an upper planar layer, and a lower layer the flutes of which extend longitudinally of the web.
Figure 6:
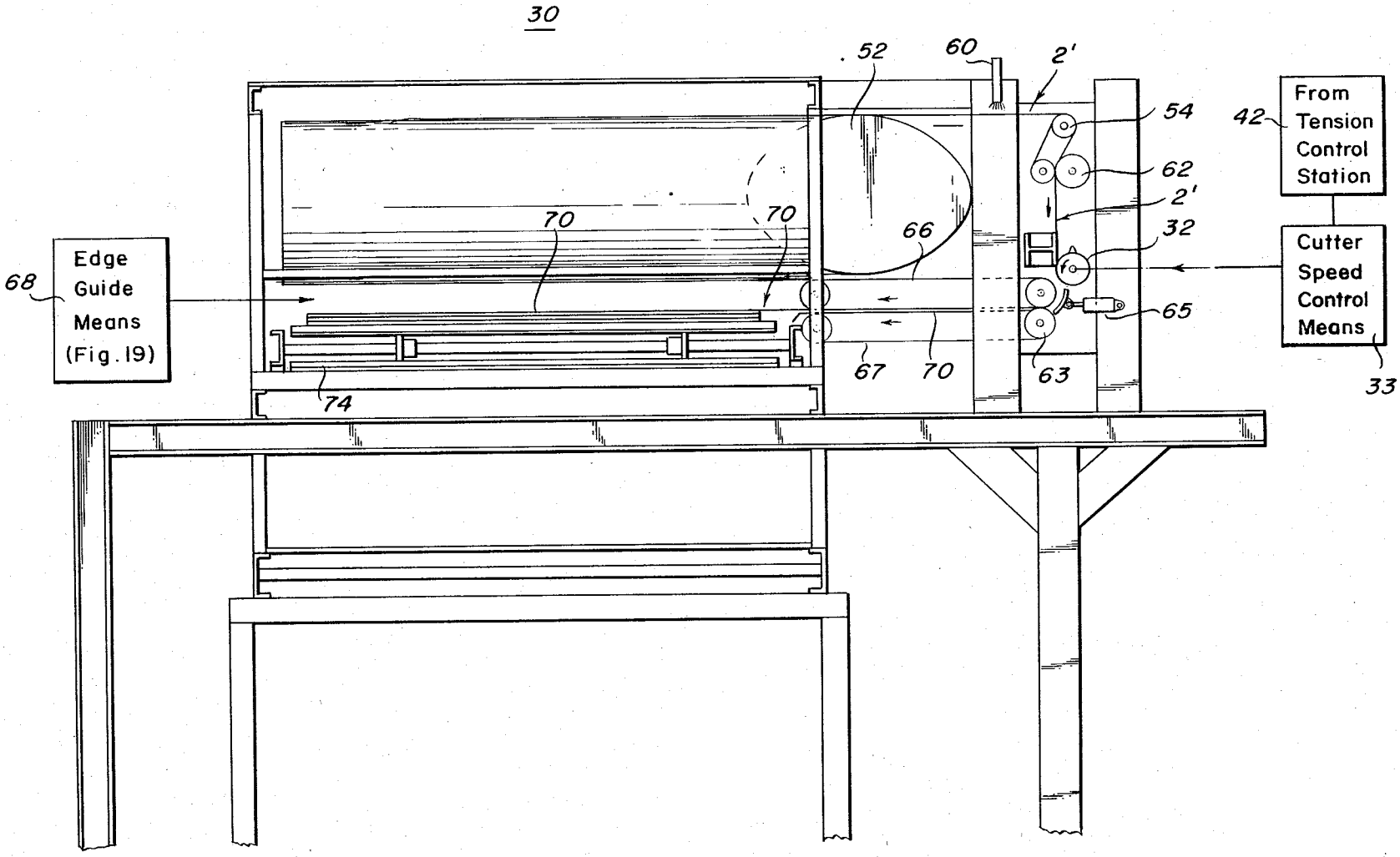
FIG. 6 is a sectional view taken along line 6—6 of FIG. 3.

Referring now to FIG. 2, the upper single facer layer 6 (including planar layer 6*a* and corrugated layer 6*b*) and the lower single facer layer 8 (including planar layer 8*a* and corrugated layer 8*b*) are supplied from corrugator sources 20 and 22, respectively to laminating station 24, and the bottom planar layer 10 is supplied from a supply roll 26 to the laminating station. As is conventional in the art, the flutes of the single facer webs 6 and 8 extend laterally (i.e., in a direction normal to the direction of travel of the webs toward the laminating station 24). In accordance with the present invention, the central web 2 is formed from an initial single facer web 2′ supplied by web source 28, which web—in accordance with a characterizing feature of the invention—includes relatively laterally displaced planar and corrugated layers 2*a*′ and 2*b*′, respectively, (FIG. 4) for effecting the desired section splicing operation, as will be discussed in greater detail below. This continuous initial web 2′ passes through a web-deflecting or turning station 30 (FIG. 6) to cause the direction of travel of the web 2′ to be turned through an angle of 90°, whereupon the direction of the web leaving the turning station is normal to that of the web entering the turning station. The turned web is then severed into generally square sections 70 by severing means 32, which severed sections (that are now arranged with their flutes extending longitudinally of the apparatus) are stacked by stacking means 34, the stacks being then transferred to storage magazine means 36 (FIG. 9), whereupon successive severed sections from successive stacks are supplied by the vacuum bar feed means 38 of FIG. 11 to the splicer station 40. As will be described in greater detail below, the sections with longitudinally extending flutes are spliced end to end to define a continuous single facer web 2 having longitudinally extending flutes, as disclosed in the aforementioned Hoelzinger U.S. Pat. Nos. 4,126,508 and 4,128,677. This continuous web 2 is supplied to the laminating station 24 via tension regulating means 42, whereupon the resultant cross-fluted corrugated laminated web 4 is produced. The cross-fluted laminated web 4, which has a linear velocity equal to that of the corrugator apparatus (i.e., about 70 meters/minute) is severed into desired lengths by cutting means, not shown.

Figures 3, 4, 5:
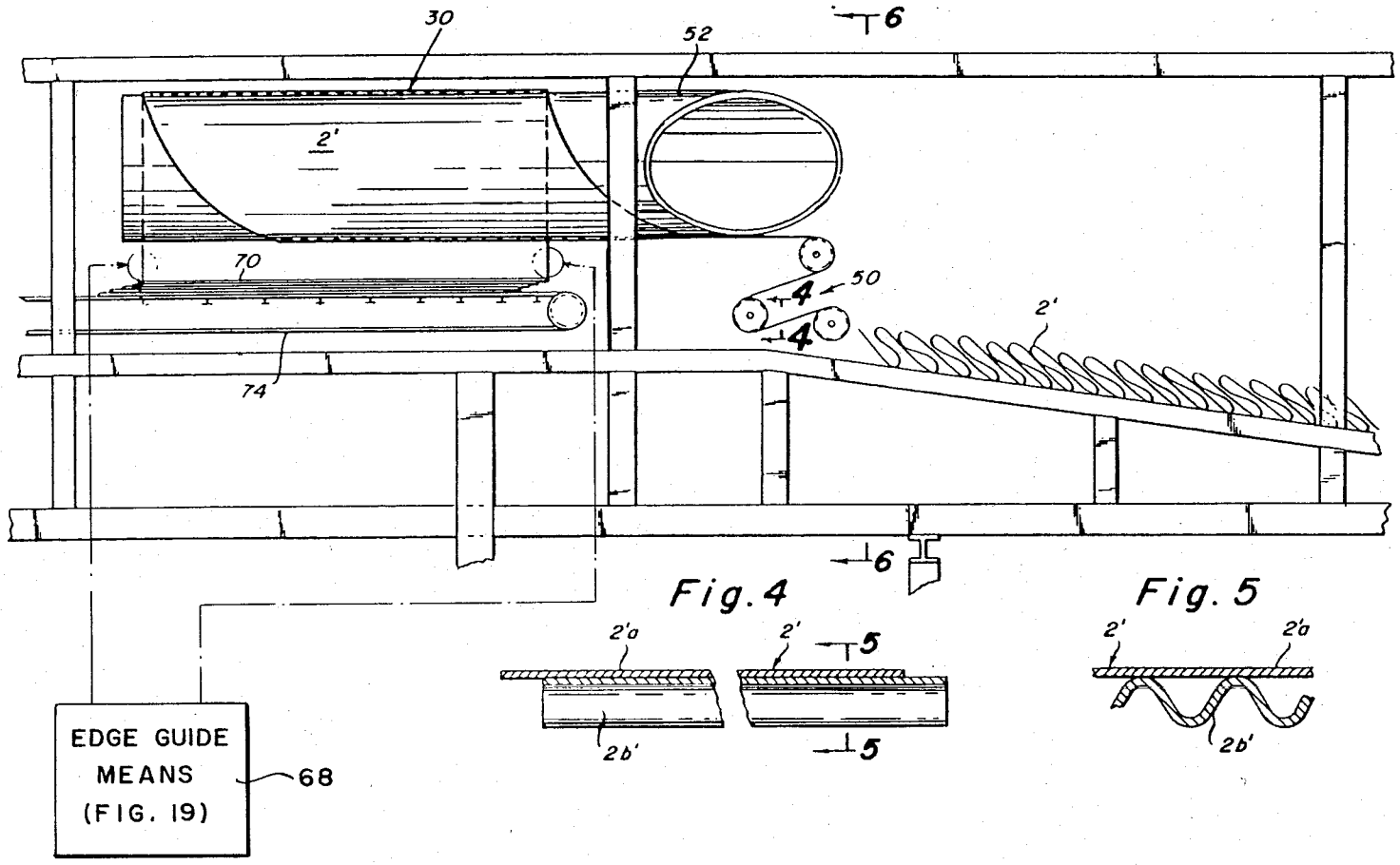
FIG. 3 is a side elevational view of the 90° turning and section severing station.
FIG. 4 is a sectional view taken along line 4—4 of FIG. 3.
FIG. 5 is a sectional view taken along line 5—5 of FIG. 4.
Figure 18:
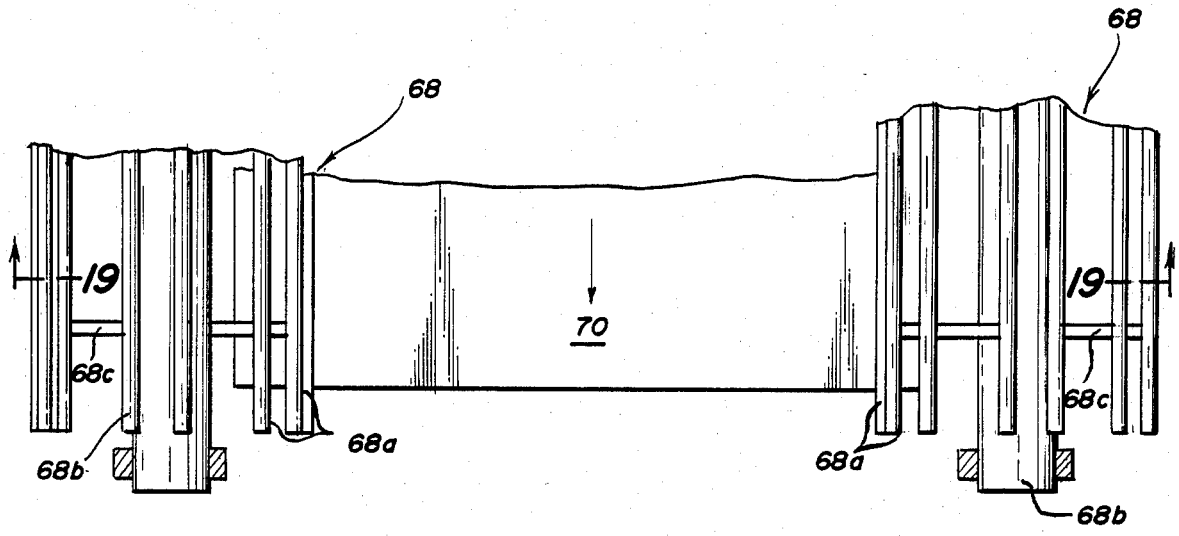
FIG. 18 is a detailed top plan view of the guide means for guiding successive sections during transport from the severing station toward a position in longitudinal alignment with the splicing station.
Figure 19:
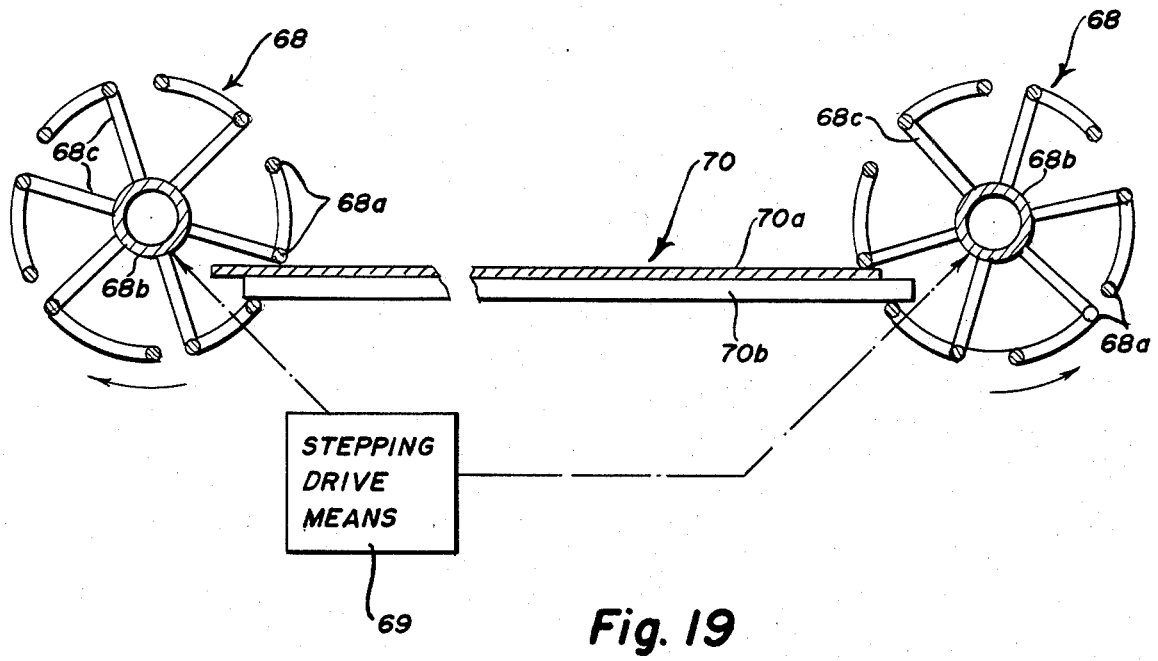
FIG. 19 is a sectional view taken along line 19—19 of FIG. 18 (and generally at the location 19—19 of FIG. 7)

Referring now more particularly to FIGS. 3–5, it has been indicated above that the planar upper layer 2*a* of the central single facer web 2′ is laterally displaced relative to the lower corrugated layer 2*b*′, the flutes of this corrugated layer extending laterally of the web 2′. The web 2′ passes over separation roller means 50, whereupon the web is guided over the angularly arranged stationary web-deflecting roll 52, thereby to turn or deflect the axis of the web through an angle of 90°. As shown in FIG. 7, during the approach of web 2′ to the deflecting roll 52, conventional pressure sensitive adhesive is applied to the exposed corrugations of laterally displaced layer 2*b*′ by the stationary adhesive applying means 58, and as the turned web 2′ leaves the deflecting roll 52, pressure sensitive adhesive is applied to the exposed lower surface of the laterally displaced planar layer 2*a*′ by the stationary adhesive applying device 60. The web 2′ is conveyed by the endless belt means 54 and the profile roller 62 (the profiled surface of which engages with the flutes of the corrugated layer 2*b*′) and is fed toward the rotary cutter means 32 (FIG. 6) that severs the turned web 2′ into sections 70 of desired length, which sections are conveyed by the endless belt means 66, 67 and the section edge guide means 68 (FIGS. 18 and 19) to the transport position in line with the original direction of feed of the central web 2′. As shown in FIGS. 18 and 19, during displacement of the severed sections 70 by the feed belts 66, 67 from the cutting means 32 to the in-line position, the forward and rearward edges of the successive sections are supported by the transverse rods 68*a* of the guide means 68, which rods are connected with the journalled shafts 68*b* by radial support arms 68*c*. The cylindrical guide means 68 are rotatably stepped in synchronism with the operation of the cutting means 32 by conventional stepping drive means 69. Since the flutes of the sections 70 now extend longitudinally, the guide rods 68*a* support the sections 70 as they are successively transported by belts 66, 67 to the in-line position, the successive sections being deposited in a shingled manner on the conveyor belt means 74 as shown in FIG. 3. Owing to this desired shingling effect, the pressure-sensitive adhesive applied to the edges by the adhesive applicators 58 and 60 is permitted to dry, and the corresponding edge portions of successive sections are prevented from being joined to each other. The guide means 68 further serves to overcome the deleterious effect of the air cushion that is present beneath the severed section which otherwise would cause the section to float and thereby prevent accurate orientation of the sections on the conveyor means 74.

In the event that it is desired to interrupt the feed of severed sections to the transport conveyors 66, 67, deflector means 65 is operated to the retracted position, whereupon the severed sections continue to travel downwardly from the cutting means 32 for collection in a waste or other receptacle, not shown.

Figure 8:
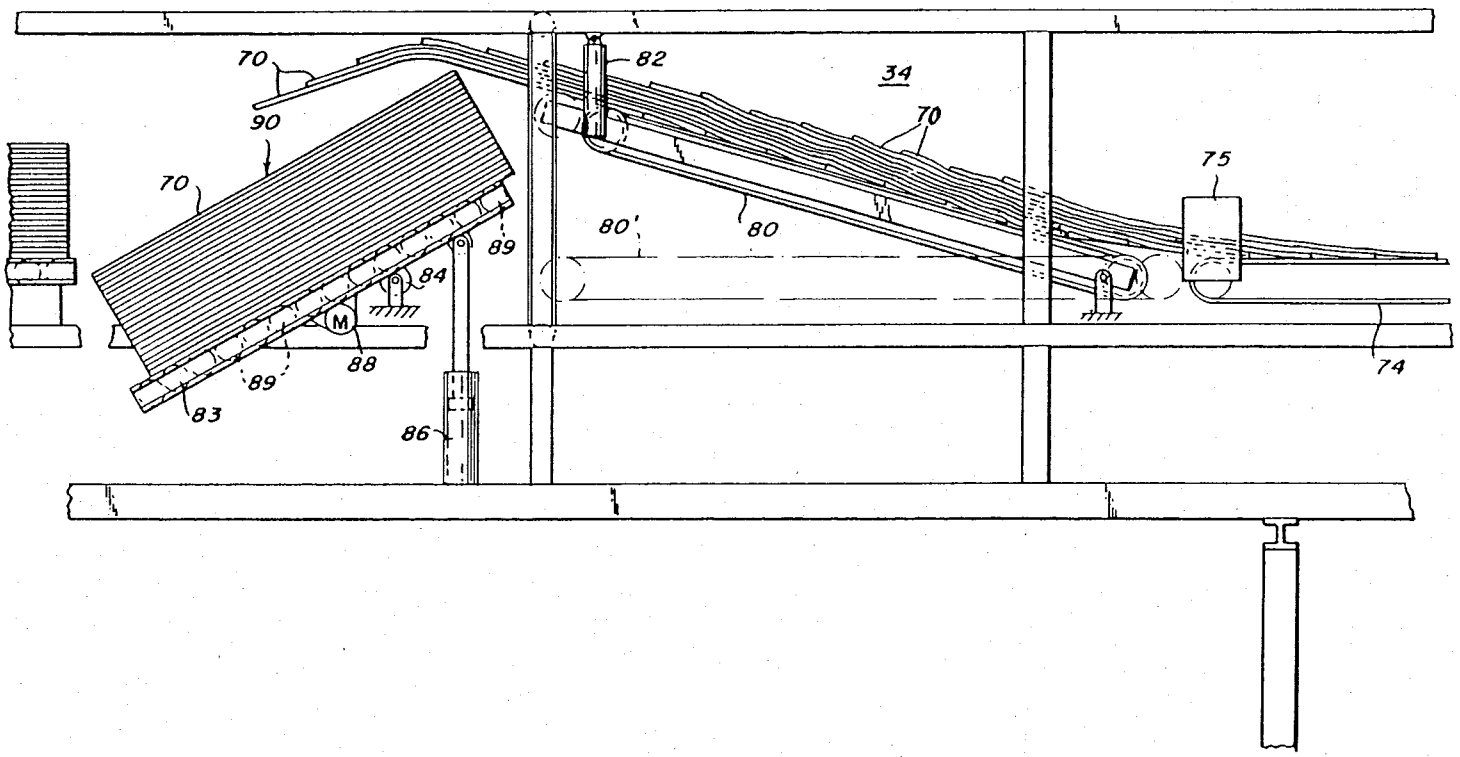
FIG. 8 is a side elevational view of the section transporting and stacking section.

Following transport to the in-line position by the belt conveyors 66, 67, the severed sections 70 (the flutes of which now extend longitudinally in the direction of the splicer station 40) are conveyed by the endless conveyor means 74 (FIG. 8) in the desired overlapping "shingled" manner toward the stacking station 34. The stacking station 34 includes endless conveyor means 80 that is pivotally connected at its rear end with the corrugator bridge for displacement about a horizontal pivot axis between the horizontal lowermost position 80′ illustrated in phantom, and the uppermost position illustrated in solid lines in FIG. 8, as controlled by the piston and cylinder elevating means 82. As indicated above, owing to the overlapping "shingling" arrangement of the severed sections 70 during transport on the conveyor means 74 and the elevating stacking conveyor 80, the adhesive which has been applied to the overlapping forward and rearward portions of the sections by the adhesive nozzle means 58 and 60 is permitted to dry, thereby avoiding sticking of the sections together when they are subsequently stacked. The adhesive is preferably of the pressure-sensitive type, and since the protruding portions of each section are spaced from each other during transport and stacking, the sticking together of sections is positively avoided.

The sections 70 are progressively stacked in a first stack 90 within the magazine station 36, the stack being formed on the pivotally supported conveyor section 83 that is progressively pivoted upwardly about fixed pivot 84 by piston cylinder motor means 86 during formation of the stack 90. Upon completion of the stack 90, the feed of web 2 is interrupted, conveyors 80 and 83 are lowered to their initial positions, and motor 88 is energized to drive the transport rollers 89 to displace the stack 90 to the stack position 92 of FIG. 9, whereupon a new stack of sections is formed in pivotal conveyor section 83. When this stack is completed, motors 88 and 93 are actuated to displace the stacks to the left in FIG. 9 to stack position 94.

In order now to splice the sections 70 together to form the desired central web 2 having longitudinally extending flutes, the forward edge of the uppermost section 70 of stack 94 is lifted by vacuum lifter 100, whereupon the vacuum lifter is operated by control means 101 to displace the uppermost section to the left for engagement between feed rollers 102,103 that feed the section 70 to the splicing station 38, which feed rolls are separable during the passage of the adhesive-bearing front edge portion of successive sections. During the progressive removal of the sections from the top of the stack 94, the stack is elevated by the hoisting cylinders 106 by the control means 108 in accordance with the stack height as sensed by the sensing means 110.

Figure 15:
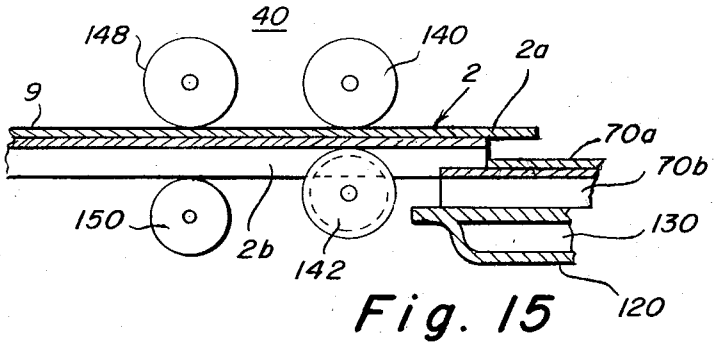
FIG. 15 is a sectional view taken along line 15—15 of FIG. 12.

The lowermost section 70 introduced into the splicing supply station 40 by the supply rollers 102, 103 is seated upon profile rollers 112 the surfaces of which correspond with the corrugations contained in the lower surface of the sections 70. Presser bar means 114 press the forward edge of the stack downwardly against the vacuum bar feed means 120 which is reciprocable from its illustrated position to the position shown in phantom to displace the lowermost section 70 forwardly beneath the retaining gate 121, whereupon the forward edge of the section is inserted between the first pair of splicing roll means 140,142. As shown in FIG. 15, the upper surface of the vacuum bar 120 is slightly below the space between the upper and lower splicing roll means, whereby the leading edge of the section 70 is displaced by engagement with the lower roll means 142 upwardly into splicing flute-interlocked engagement with the trailing edge of the spliced web 2, the pressure-sensitive adhesive coatings on the projecting portions being pressed into engagement with the adjacent cooperating surface.

Figure 11:
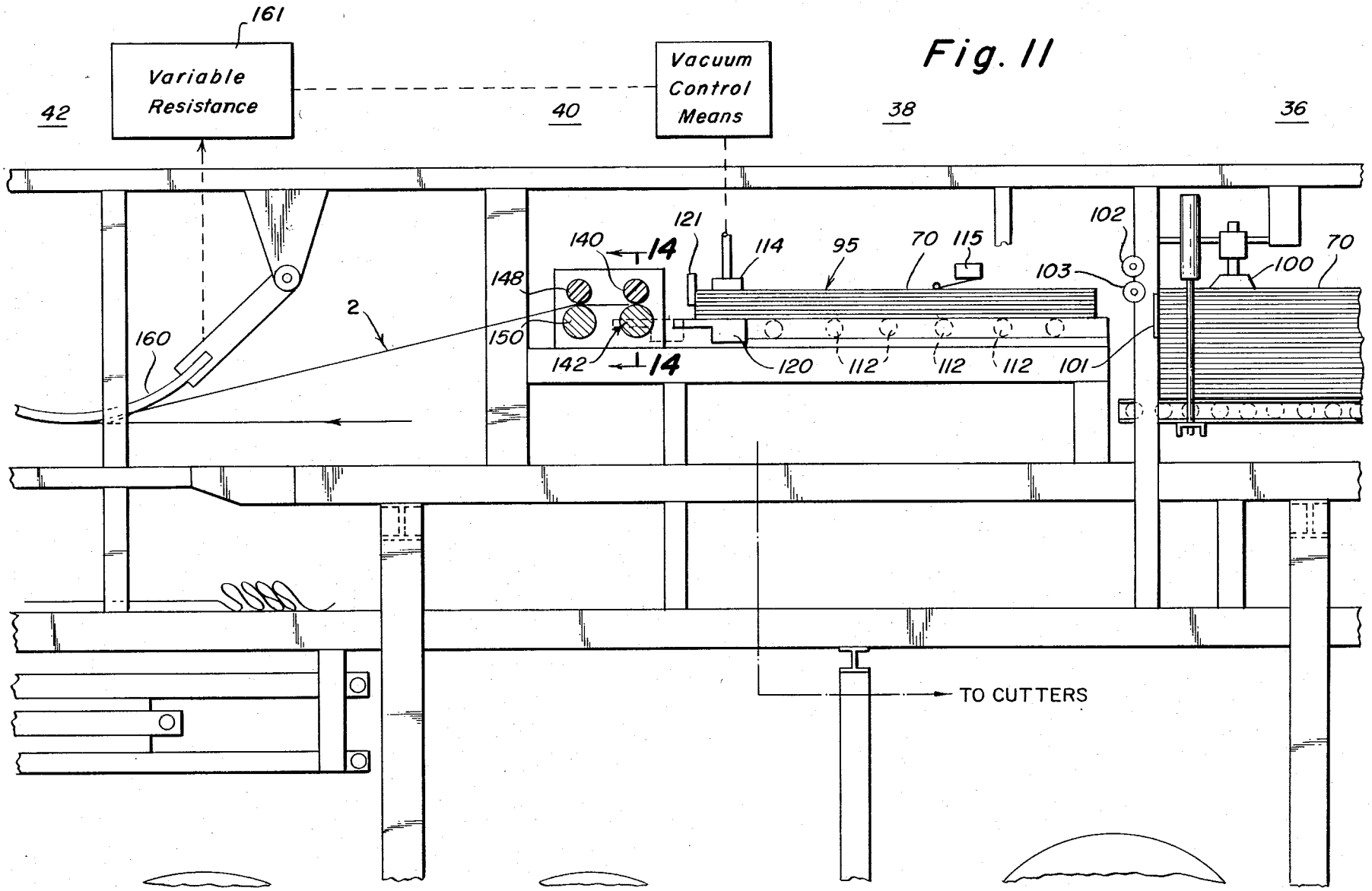
FIGS. 11 and 12 are side elevation and top plan views, respectively; of the splicing station.
Figure 12:
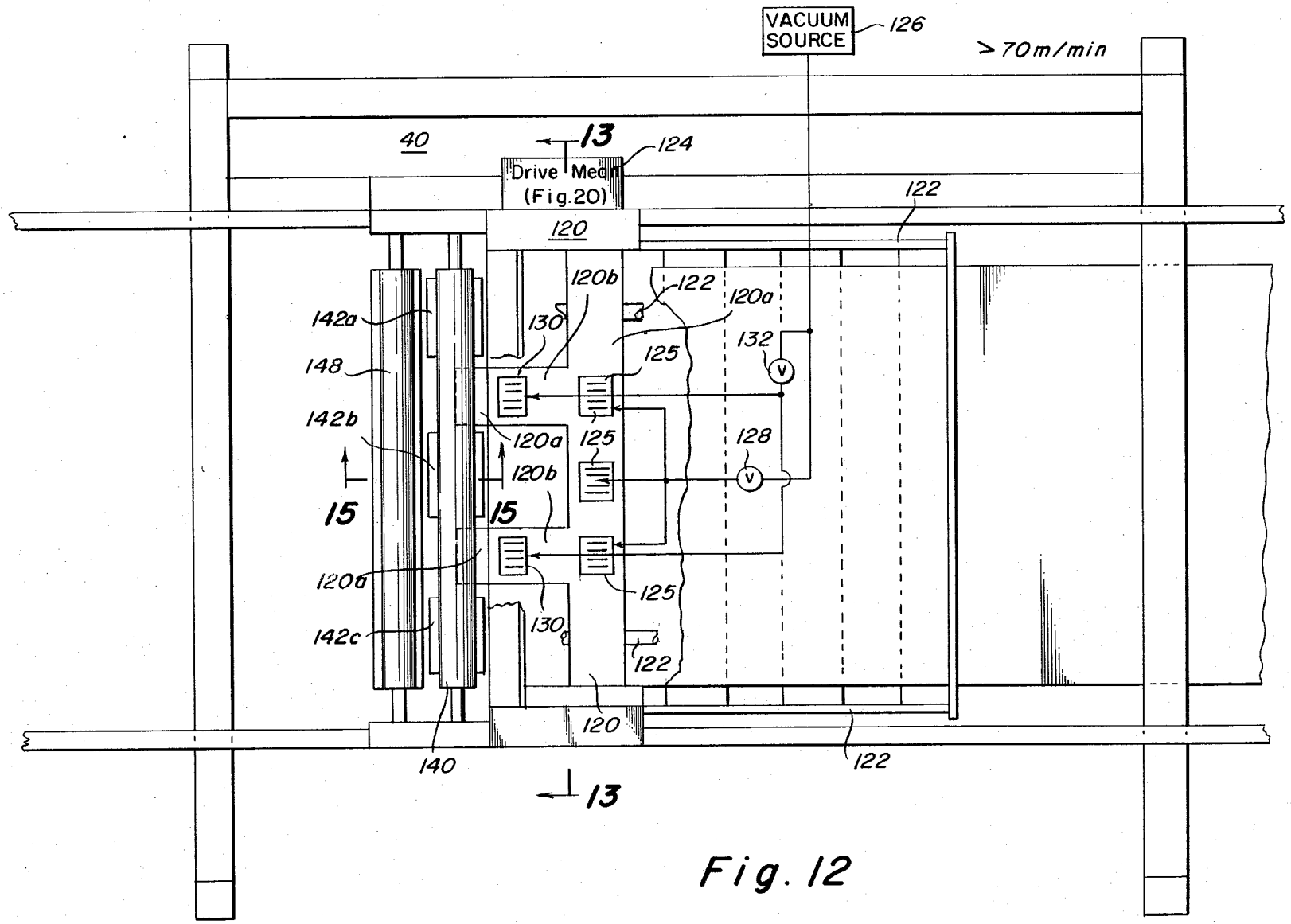

Referring to FIG. 12, the vacuum feed means 120 reciprocates on guide bars 122 in a direction longitudinally of the apparatus, as controlled by the drive means 124. The vacuum bar means includes a main body portion 120*a* containing three vacuum chambers 125, and a pair of spaced forwardly extending portions 120*b* each of which contains a vacuum chamber 130. The lower splicer roll means 142 comprises three lower splicer roll portions 142*a*, 142*b*, 142*c* that are spaced to receive the forward projections 120*b* of the vacuum bar means when the vacuum bar means is in the left-hand position of FIG. 12 (illustrated in phantom in FIG. 11). As shown diagrammatically in FIG. 12, the first chambers 125 are connected with vacuum source 126 via conduit means containing first control valve 128, and the second vacuum chambers 130 are connected with the vacuum source via second control valve 132.

Figure 13:
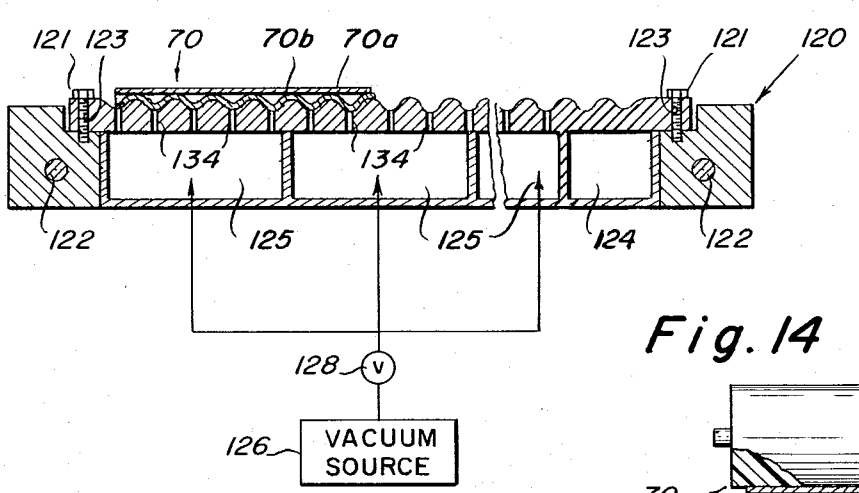
FIG. 13 is a sectional view taken along line 13—13 of FIG. 12.

Referring now to FIG. 13, the upper surface of the vacuum bar 120 is profiled to conform with the flutes of the lower corrugated surface 2*b* of the severed section 70. The chambers 125 and 130 of the vacuum bar means 120 communicate with the trough portions of the profile surface via passages 134, whereby the section 70 is attracted by suction into tight engagement with the reciprocating vacuum bar means 120. Thus, when valve means 128 and 132 are operated to evacuate chambers 124 and 130 to thereby effect suction on the severed section 70, the vacuum bar is displaced by drive means 124 along guide rails 122 in the direction of the splicing station 40, and when the valve means 128 and 132 are operated to interrupt the communication between chambers 125 and 130 and the vacuum source 126, thereby to release the section from the vacuum bar means, the vacuum bar means is retracted to its initial position for engagement with the next severed section supplied to the profile rollers 112.

Figure 20:
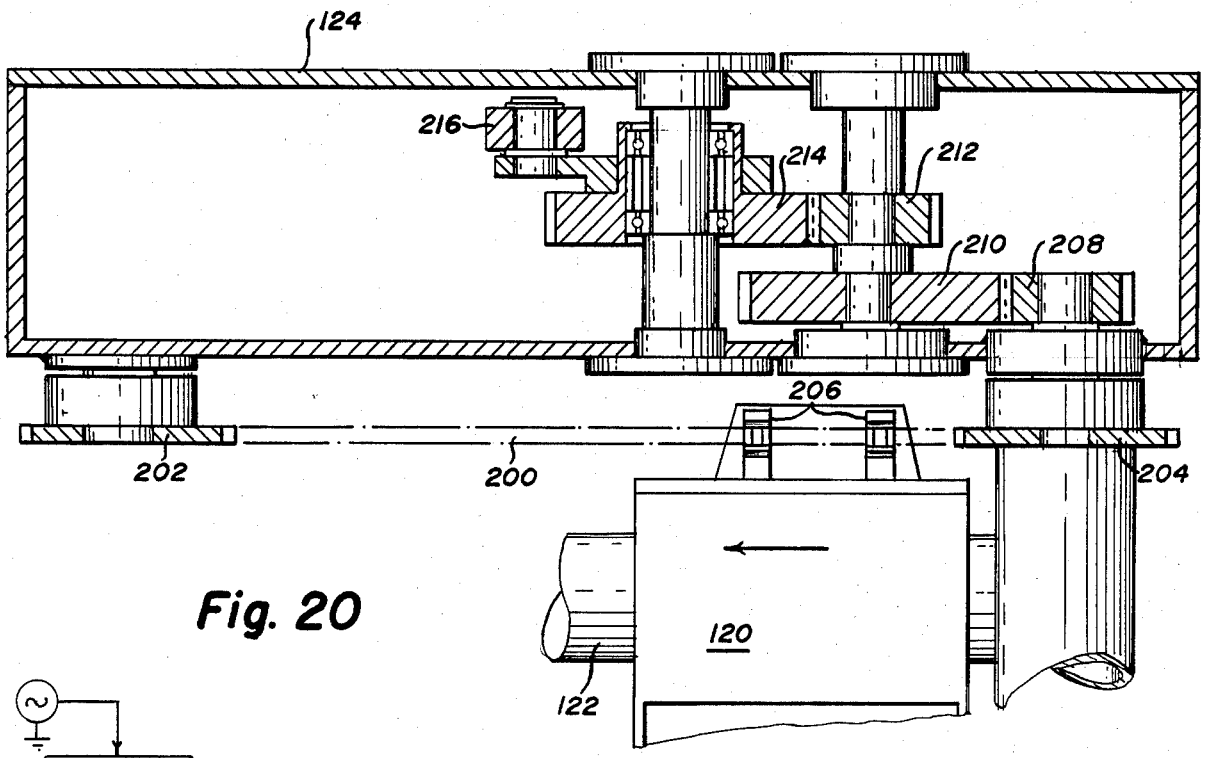
FIG. 20 is a detailed sectional view of the drive means for driving the vacuum bar feed means.
Figure 21:
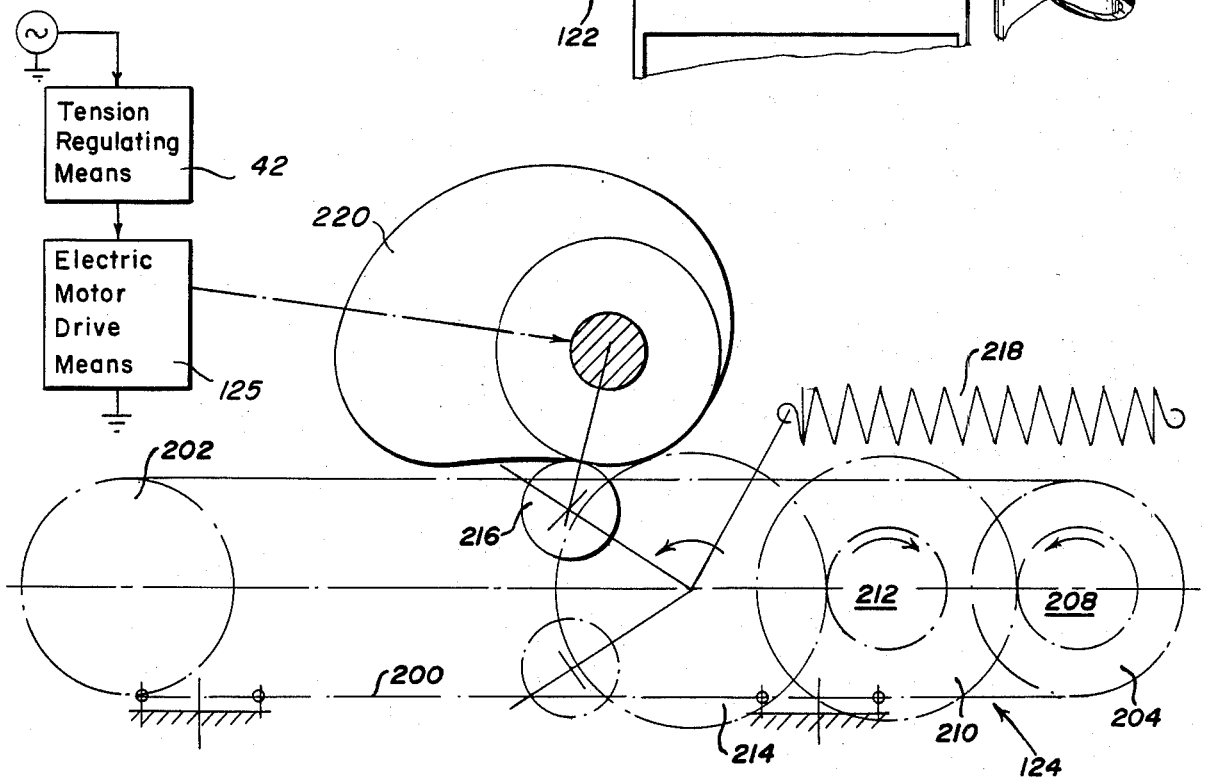
FIG. 21 is a diagrammatic illustration of the operation of the cam means of the vacuum bar feed means.

Referring to FIGS. 20 and 21, the drive means 124 for reciprocating the vacuum bar means 120 relative to the frame includes an endless sprocket chain 200 mounted on driven and driving sprocket gears 202, 204, respectively, the sprocket chain being connected by connectors 206 with the vacuum bar means. Sprocket gear 204 is connected with the pinion 208 of gear train 210, 212, and 214, that, in turn, is driven by cam follower 216 that is biased by spring 218 into engagement with the surface of driving cam 220, which cam, in turn, is driven by electric motor drive means 125 as controlled by the tension regulating means 42.

Figure 14:
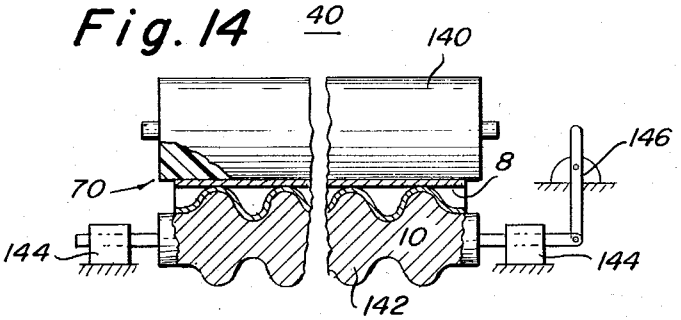
FIG. 14 is a sectional view taken along line 14—14 of FIG. 11.

The severed section 70 is introduced between the upper rubber roller 140 and the profiled lower roller means 142 of the splicing station 40, as shown in FIGS. 14 and 15. The lower roller means 142 is mounted in bearing means 144 for a slight lateral adjustment by the adjustment linkage 146. The section 70 is accelerated by the vacuum bar feed means 120 so that the protruding forward edge of the corrugated layer 70*b* of the section 70 underlies the protruding trailing planar edge 2*a* of the spliced center web 2, as shown in FIG. 15. The section 70 is then spliced to the trailing edge of web 2 by the pressure-sensitive adhesive on the lower surface of the protruding planar portion 2*a* of the web 2, and the pressure-sensitive adhesive on the upper surface of the protruding corrugated layer at the forward end of the section 70, which portions are pressed together during passage between the resilient roller 140 and the profile roll means 142, and the subsequent passage between the metal roller 148 and the brush roller 150 of the splicing means 40. The spliced web 2—which now has longitudinally extending flutes—passes through the tension-responsive means 160 of tension regulating station 42, whereby tension-control variable resistor 161 is operated to control the electric motor 125 of the vacuum bar drive means 124, as will be described in greater detail below with regard to the detailed disclosure of FIGS. 20 and 21. The tensioned spliced web 2 is guided in an S-shaped path by a stationary curved guide member 162 having a relatively large radius of curvature, whereby damage of the flutes of the corrugated layer is avoided. Depending on the tension of the spliced web 2, the tension-sensitive element 160 is pivoted to vary the setting of a variable resistance 161 which in turn controls the electric motor 124*a* of drive means 124 for the vacuum bar member 120. The continuous spliced web 2 is then supplied to the laminating station 24 for bonding to the single facer webs 6 and 8 (each of which has flutes that extend in the transverse direction as distinguished from the longitudinally extending flutes of the web 2).

OPERATION

In operation, the slack portion of the web 2' on the bridge of FIG. 3 is smoothed out by the loop separator means 50 before the board is drawn around the stationary angularly arranged web-deflecting roll 52 by the single facer feed means including profiled roller 63 which acts in cooperation with endless feed belt 61.

As shown in FIG. 7, the adhesive supply devices 58 and 60 supply adhesive to the exposed edge portions of the corrugated and planar layers 2*b'* and 2*a'*, respectively, of the initial web 2', whereupon the web 2' is severed into sections 70 by the cutter means 32 (FIG. 6) as controlled by the tension regulating station 42 and cutter control means 33 (FIGS. 2 and 16), as will be described below. The severed sections 70 are conveyed by the endless belts 66, 67 toward the initial longitudinal axis of the web 2', as guided by the edge guide means 68 (FIGS. 3, 7, 18 and 19). As the severed sections 70 are conveyed successively to the in-line position of FIG. 7, they are deposited by the edge guide means 68 in a shingled manner on endless conveyor 74 as shown in FIG. 4, whereby the pressure-sensitive adhesive that has been applied to the exposed protruding edge portions of the sections is permitted to dry. The shingled sections are supplied by stacking conveyor means 80 to form the first stack 90, the operation of the corrugator supply system is interrupted, cylinder 86 is operated to pivot the support 83 about pivot axis 84 to its horizontal position and motor 88 is operated to displace the stack 90 to the stack position 92 shown in FIG. 9. The corrugator supply system is then reactivated, and a second stack is similarly formed at position 92. The corrugator system is then deactivated, stacks 90 and 92 are shifted to positions 94 and 92, respectively whereupon the corrugator system is again operated to continuously supply the web 2' to the cutting means 32 for forming the sections 70. The vacuum lift operator 101 is operated to supply successive uppermost sections from the stack 94 to the splicing station 38 to form a final stack 95. The vacuum bar means 120 transports successive lowermost sections from stack 95 to the splicing roll means 140,142, as shown in FIG. 11, whereupon the forward edge of section 70 is spliced to the trailing edge of the spliced web 2, as shown in FIGS. 14 and 15, the flutes of the corrugated layers 2*b* and 70*b* at this point of splicing being in flute enmeshing relation.

It should be mentioned that transport from the intermediate storage magazine 92 into the final storage magazine 94 is accomplished in a manner similar to the transport from 90 and 92. In contrast to storage magazines 90 and 92, however, magazine 94 is equipped with a holsting mechanism 106 so controlled by the upper regulator 108 that, during the continuing emptying of magazine 94, the entire stack is successively pushed into approximately the same position. On this upper position, the vacuum transfer means 100 transports the cardboard section 70 into the splicer station 40. The vacuum hoist means at first performs a small hoisting motion so that the uppermost cardboard is released from stop 101. Then there is a forward movement in the direction toward the splicer station with a length of about 1 m. This hoisting mechanism must work at production speed, in other words, 70 m/min+10% for the magazine changing time interval. During the feed, the supply roller system 102 is somewhat separated so that the forward, glued edge of a section 70 does not touch these rollers. After the glued edge has passed by, the rollers close in on the cardboard section 70 at the moment when the vacuum feed 100 has reached maximum speed. Roller system 102 thus runs at production speed+10%. When the glued section end has passed the rollers, the latter open up shortly before so that the last portion of the section 70 will slide into vacuum bar station 38 at its own inherent speed. To make sure that contact between the rollers and the glue will be avoided, deflectors 105 are provided, as shown in FIG. 10. To stiffen the corrugated cardboard section 70 during the pushing phase through the roller system 102, 103, the two outside ends are lifted by guide means 107. During the pushing phase by the roller system 102, 103, the vacuum feed device 100 returns to its forward starting position.

At vacuum bar station 38 there is provided a supply of about 10 cardboards or 18 seconds in order to bridge the charge cycle of magazine 94. The scanner 115 is provided as an extra safety measure for the possible overfilling or underfilling of the magazine. After lining up the lowest section 70 by means of the profile rollers 112 which rotate in a direction opposite the direction of movement and which oscillate partly, and on stop 117 there then takes place the insertion into the splice station. After the end of the ready-spliced cardboard has passed the inlet barrier 119, the line-up of the next section 70 falls on the vacuum bar 120. Hold-down means 114 maintains support of the sometimes very wavy cardboard. The dropping of the section is furthermore supported by the vacuum, in that vacuum valves 128 and 132 prevent premature release.

After the next section 70 lies below the inlet barrier 129, there commences the forward transport of the vacuum bar 120 via the vacuum bar drive means 124 which brings the next section into the splicing station 40. The first two rollers of the splicing station consists of the multi-sectioned steel roller 142 and the resilient opposed roller 140.

The start of the new section 70 is conducted under the trailing portion of the web 2, and the connection of the pressure-sensitive adhesive is brought about by means of pressure between rubber roller 140 and profile roll means 142.

Because of the determined profile subdivision tolerances, both roll means 142 and the profile plates of vacuum bar 120 and the profiled rollers 112 may be designed for lateral adjustment relative to the direction of production. The brush roller 150 and the counter-roller 148, by means of spreading, establishes the final, firm gluing between the new section 70 and the spliced web 2. The drive of the vacuum bar station 38 is effected by gear means 124 which includes, as shown in FIGS. 20 and 21, a drive cam 220 driven by electric motor drive means 125 in accordance with a regulated voltage supplied via tension regulating means 42.

During the splicing operation, the vacuum bar member 120—in the activated suction-establishing condition—transports the severed section between the splicing rollers 140 and 142 (FIG. 11). The reciprocatory speed of the vacuum bar 120 is accelerated under the control of the cam means 220 to a greater speed of travel than that of the spliced web, whereupon the two segments overlap during passage through the splicing rollers 140 and 142 in the direction of feed. After this severe acceleration, the section travel is slowed down to that of the spliced web 2, as again controlled by the cam 220.

During the connection of sections 70 and the rear end of web 2, these parts are so attached together that the longitudinally extending corrugations of both parts engage each other so that a defined relative positioning of both parts is guaranteed also laterally with respect to the direction of feed.

Figure 9:
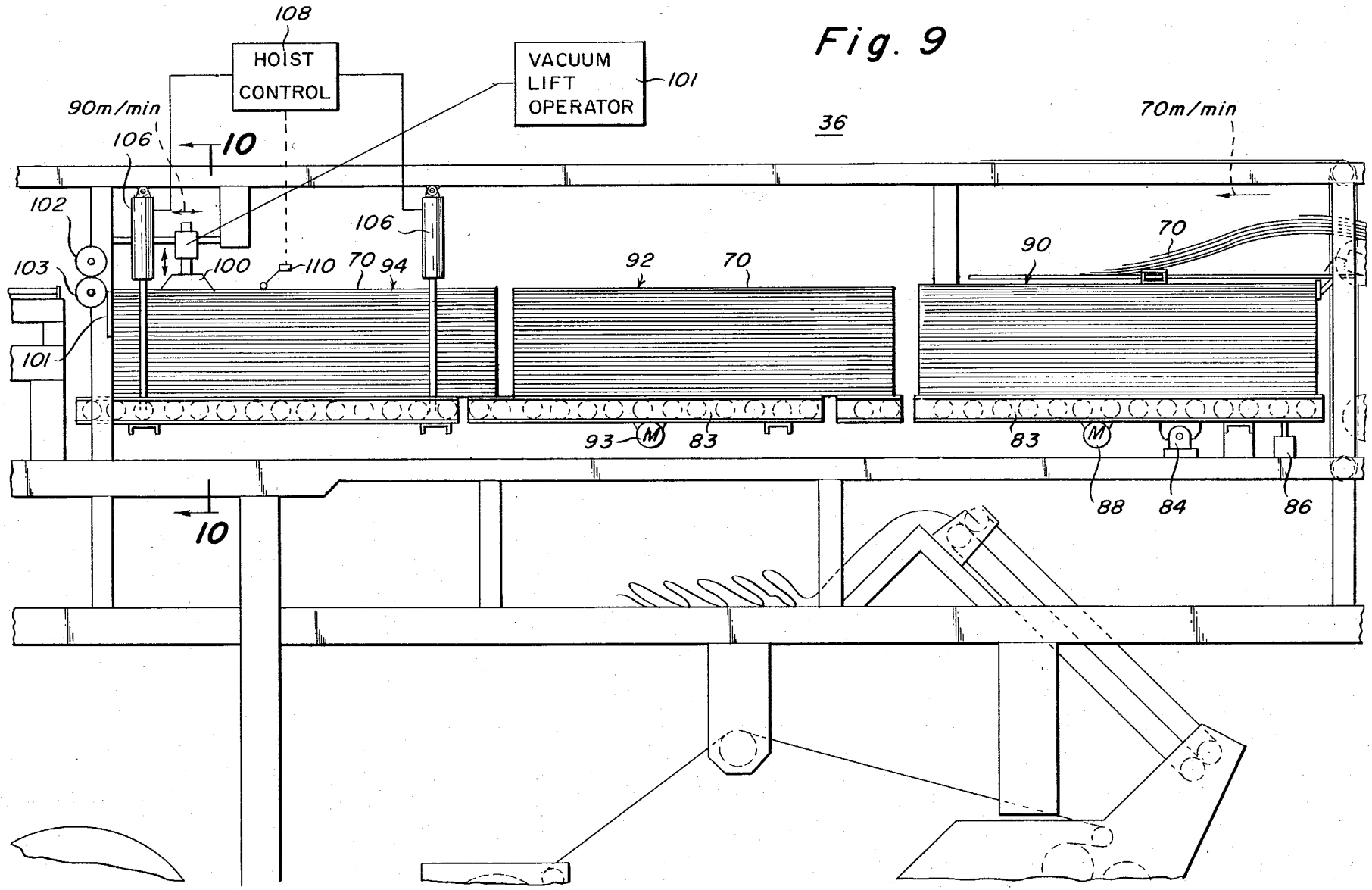
FIG. 9 is a side elevational view of the stack magazine station.

It should be pointed out that the transport of the stacks in stacking station 34 from the position of stack 92 into that of stack 94 takes place in the same manner as the transport from the position of stack 90 into that of stack 92. In contrast to the storage units or magazines of stack 90 and 92, however, the magazine of stack 94 is equipped with a hoisting mechanism (i.e., hoisting cylinder 106) which is controlled by the control mechanism 108 during the continual transmission of the stack 94 so that the upper edge of stack 94 essentially retains the same position. From this upper position, the vacuum device 100 transports the upper section 70 into the splicing station 40. For this purpose, the vacuum device first of all performs a minor lifting motion so that the uppermost segment is lifted over a stop 101*a* which extends along the forward edge of stack 94 laterally with respect to the direction of feed (FIG. 9). Then comes a forwad movement in the direction toward the splicing station which for example, extends over a length of 1 m. This feeder motion of the vacuum device 100 must be accomplished at a speed which is about 10% above the production speed (the production speed for example can be 70 m/min) because the time losses must be made up due to forward feed of the stacks.

During the feeding operation, the transport roller 102 is somewhat displaced from transport roller 103 so that the forward edge of section 70, which is provided with adhesive, will not touch the rollers. The moment the edge, to be provided with glue, has run through the slit between the two transport rollers, the two rollers again move closer to each other and come to rest on the segment the moment at which the feeding speed of the vacuum jack has reached a maximum. Transport rollers 102 thus run at a feeding speed which is about 10% above the production speed. Shortly before the glue-coated terminal edge of the transport rollers has been reached, these rollers again are removed from segment 70 so that this segment, because of the inherent speed and its inertia, will slide into the vacuum conveyor 38.

In order finally to make sure that any contact between the transport rollers and the applied glue will be avoided, fenders 105 (FIG. 10) are provided. To stiffen segments 70 during the phase in which the segment is pushed through the transport rollers 102 and 103, the two outer edges are lifted by guide elements 107 (FIG. 10). During the interval of time in which the transport rollers 102 and 103 handle the feeding of the segment, the vacuum device 100 returns to its starting position.

In the vacuum conveyor 38, for example, we might have ten sections stacked on top of each other. This corresponds, for example, to a supply of 18 seconds in the mechanism described. With this supply, the loading cycle in the magazine of stack 94 can be covered. As an additional safety measure, to avoid possible overfilling or underfilling of the magazine, a measurement sensor 115 is provided which corresponds to the height of the stack (FIG. 11). To line up the lower segment of post 95, the profile rollers 12 rotate in a direction opposite to the direction of feed. Besides, these rollers are eccentrically positioned whereby an oscillating motion of their profiled circumferential surfaces is produced which means that the corrugations of the corrugated layer 70*b* of the lower segment 70 engage the corresponding profiles of the profile rollers. This guarantees alignment laterally with respect to the direction of feed. The lineup in the direction of feed is effected by stop 121, a relative shift of the segments in stack 95 being avoided by pressure element 114 which presses the sections together over the largest portion of the operating cycle.

As soon as the spliced-on lower section has been pushed past the stop 121, the superposed segment 70 falls down upon the vacuum conveyor member 120. The pressure element here furthermore has the job of lowering the entire stack 95 in a defined fashion so that the precise location of the segments in the magazine can be retained. The lowering of the stack is also made easier by virtue of the fact that the control valves 128 and 132 prevent early release.

As soon as the next segment lies on the vacuum conveyor element 120, the latter's feed motion begins and that motion is brought about by motor 124. In this fashion, the next segment is transported to the splicing station 40. The splicing roller 140 is formed from a resilient material, while the splicing roller 142, consisting of various segments, is made of steel.

The forward edge of the new segment is then placed under the terminal portion of course 2 in the manner described and a connection is established by pressing together the two parts between the splicing rollers 140 and 142.

Because of the profile subdivision tolerances, it is possible to adjust both the profiled splicing rollers 142 and the profiled level surface of the vacuum conveyor element 120 as well as the profiled rollers 112 laterally to the direction of feed. Brush roller 150 and counter-roller 148 finally establish firm terminal contact between new segment 70 and the continuing course 2.

As explained earlier, the drive of the vacuum conveyor element is brought about by means of a motor 124 which comprises a cam disc 220 that is driven by an electric motor 124*a*. The speed of the drive motor 124*a* here can be adjusted by the tension-sensitive element 160. As seen from FIG. 16, the spliced web 2 with its rear end is clamped in the splicing station between roller pairs 140, 142, and 148, 150 so that the feed motion of web 2 provides a certain degree of tension.

Figure 16:
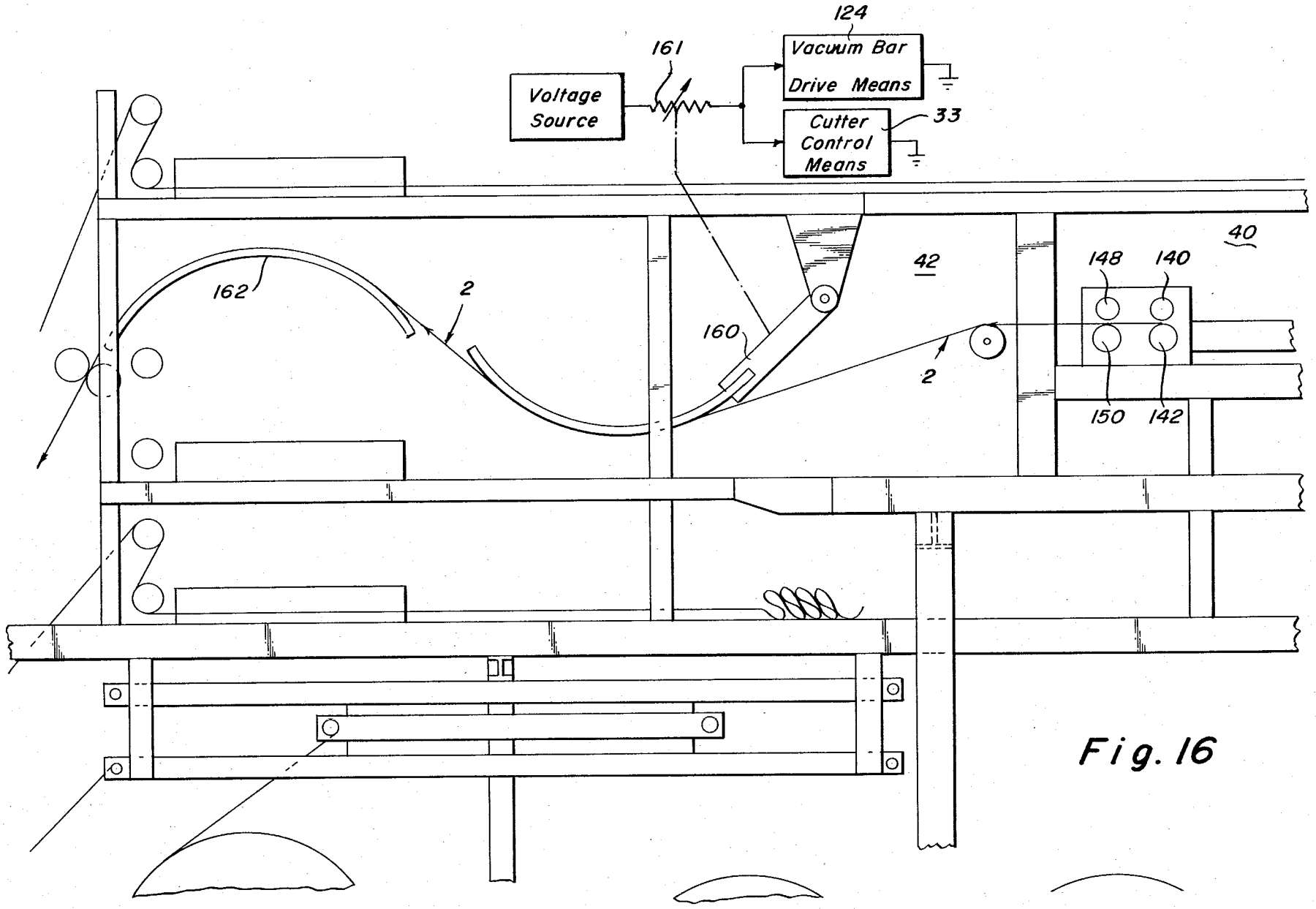
FIG. 16 is a side elevational view of the continuous web tension regulating station.

In the area located downstream from splicing station 40, the web 2 is guided, as shown in FIG. 16, by means of two curvatures which run in the opposite direction and which on the one hand are defined by the tension-sensitive element 160 and on the other hand by the diversion element 162. If the speed of web 2 is increased, the web will become tight in this area and the tension-sensitive element 160 is swung upwardly. Conversely, the bulge of the web increases as the speed slows down so that the element 160 is pivoted in the other direction. The pivotal motion of element 160 changes the value of the variable resistance 161 and thus the speed of electric motor 124*a*. Overall, this produces a situation in which the feeding speed of the vacuum conveyor element is changed, specifically, by way of adjustment to the altered speed of web 2. If the speed of web 2 increases, there is also an increase in the speed of the vacuum conveyor member 120 and conversely. In this way it is assured that, independently of the particular speed of course 2, a constant relationship in the splicing station is maintained.

Because a change in the feeding speed of vacuum conveyor element also has a reaction effect on the production speed of the rest of the mechanism, this production speed is also controlled by the tension element 160. This applies for example to the drive of the cutting mechanism 32 which is controlled via a control device 33 which likewise can be influenced by the value of the changeable resistance 161 (FIG. 16).

Because the buildup of the supply on conveyor belt 74, conveyor mechanism 80, and stacking station 34 (stacks 90, 92, 94) in the example described takes about 20 minutes and because a feed of stack 90 beyond the position of stack 92 into the position of stack 94 takes place only when the stacking station is completely filled or empty, a maximum production interruption time of no greater than 10 minutes is obtained. This time results from the fact that 10 minutes are required for the complete taking-down of stack 94 at half production speed. During those 10 minutes, stacks 90 and 92 can be filled up again. If this maximum interruption time is exceeded during the filling of the stacking station, then the entire corrugated paper supply system of the original web 2' is turned off until the mistake has been corrected. In other words, 10 minutes are available during operation to correct any trouble.

Should difficulties arise in the production mechanism 28 for the continuing web 2', one can withdraw the deflection element 65 (FIG. 6) so that the separated segments 70 will directly get into the waste container not shown in the drawings. During that interval of time, no segments are transported by the endless conveyor belts 66 and 67 to the transport position illustrated in FIG. 7 and to the conveyor mechanism 80.

Figure 17:
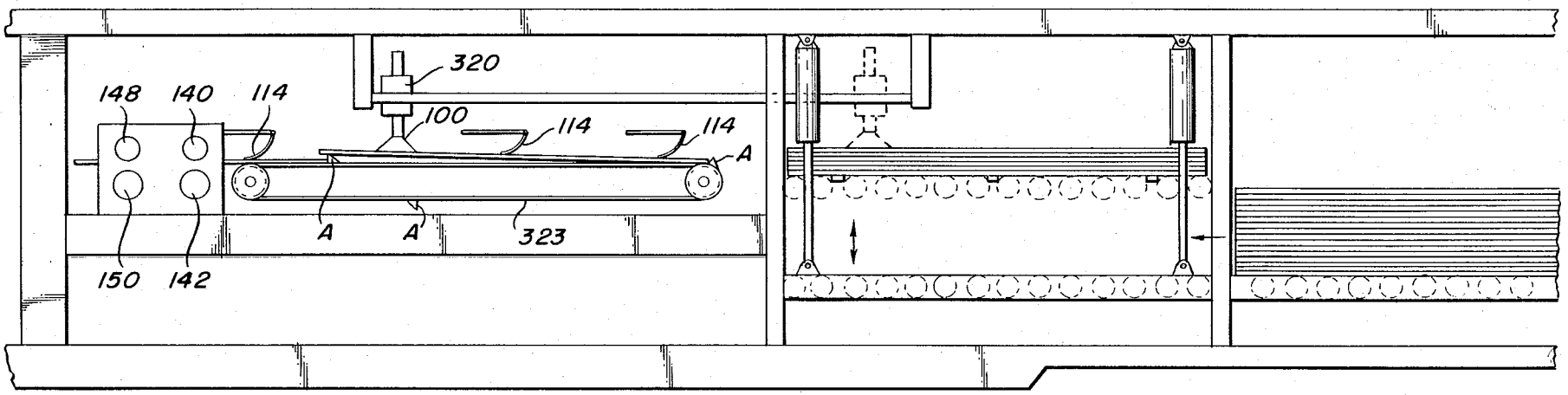
FIG. 17 is a side elevational view of a modification of the splicer means of FIGS. 11 and 12.

In the embodiment illustrated in FIG. 17, the vacuum conveyor element 170 of FIG. 11, is replaced by an endless chain 323 which has feeder projections arranged at an interval from each other and those projections come to rest against the rear edges of the successive segments. Instead, it is also possible to use a vacuum-impacted conveyor belt in order to introduce the segments between the splicing rollers 140 and 142 and the successive rollers 148 and 150. Elastic downholders 114*a* hold the segments in contact with chain 323 or the vaccum belt.

In this example, no stack is formed in front of the splicing station; instead, the sections taken off stack 94 are directly placed upon chain 323 or the vacuum belt and are immediately supplied to the splicing station. Intermediate storage thus takes place only in stack 94 and in front of it.

From FIG. 13 is will be seen that the profiled surface of the vacuum conveyor member 120 contains various parts which are connected by means of pins 121*a* and slits 123. In this way adjustment in the horizontal direction is permitted in a direction normal to the direction of the corrugations. In the same manner, profile rollers 142 of FIG. 14 can be adjusted normal to the direction of corrugations, so that the grooves in the individual sectors of the vacuum conveyor element or in the individual sectors of the profiled roller 142 can be adjusted in the desired manner.

While the preferred forms and embodiments of the invention have been illustrated and described as required by the Patent Statutes, other changes and modifications may be made without deviating from the invention set forth above.

What is claimed is:

1. Apparatus for splicing a single facer corrugated section (70) to the trailing edge of a spliced web (2) travelling longitudinally at a given linear velocity, said section and said web each having planar and corrugated layers, the flutes of the web extending longitudinally and the flutes of the section being parallel with the flutes of the web, the planar and corrugated layers of the section and of the web being correspondingly slightly offset in the direction of the flutes so that at their adjacent ends, the planar layer of one member protrudes beyond the corrugated layer of said one member, and the corrugated layer of the other member protrudes beyond the planar layer of said other member, comprising (a) a frame arranged in the path of longitudinal travel of the web;

(b) splicer roller means (140,142) connected with said frame transversely of the web for bonding to the trailing end of the web the adjacent portion of the corrugated section, said splicer roller means including cooperating upper and lower roll means, said lower roll means including a plurality of colinearly arranged spaced roll sections (142*a*–142*c*);

(c) vacuum bar means (120) connected with said frame adjacent said splicer roller means for displacement longitudinally of the web, said vacuum bar means including a body portion (120*a*) arranged transversely across the web, and longitudinal extension portions (120*b*) that are adapted to extend longitudinally within the spaces between the lower roll sections, respectively, said vacuum bar means having a profiled upper surface including longitudinally extending grooves corresponding with and receiving the flutes of the corrugated layer of the section;

(d) means for evacuating the bottom portions of at least some of said grooves, whereby the lowermost peaks of the corrugations of the corrugated layer of the section are drawn by suction into the grooves, thereby to maintain the section in engagement with said profiled surface, said evacuating means including (1) first (125) and second (130) chambers contained in said vacuum bar body and extension portions, respectively, said chambers being in communication with the bottoms of at least some of said grooves;

(2) a vacuum source (126); and (3) means including first (128) and second (132) control valve means connecting said first and second chambers with said vacuum source, respectively; and (e) drive means (124) operable when the section is maintained in suction engagement with said vacuum bar member for initially displacing said vacuum bar member in the direction of the web at a higher velocity than said web uniform linear velocity, said drive means being subsequently operable at said given linear velocity when the rear portion of the spliced web is in superposed relation with the forward portion of the section, said control valve means being operable from a normally open condition to a closed condition when said vacuum bar means is operable at said uniform linear velocity, whereby the section is accurately oriented and supported during introduction to said splicer roller means, thereby to assure proper enmeshing engagement between the flutes of the corrugated layers of the section and the web, respectively.

2. Apparatus as defined in claim 1, wherein said frame includes a plurality of longitudinally extending guide rods (122) upon which said vacuum bar means is mounted for longitudinal travel relative to said frame; and further wherein said vacuum bar displacing means includes cam (220) and follower (216) means for reciprocating said vacuum bar means along guide rods at a varying velocity corresponding to the contour of said cam means.

3. Apparatus as defined in claim 1, wherein said splicer roll means includes an upper roll (14) having a smooth cylindrical surface, and further wherein at least one of said lower roll sections includes a profiled surface corresponding with the corrugations of the corrugated layer (70*b*) of the corrugated section.

4. Apparatus as defined in claim 1, and further including tensioning means (160) for tensioning the spliced web (2) leaving said splicing roller means, and control means (161) operable by said tensioning means for varying the drive speed of said vacuum bar member (120) and said splicing means (40) to maintain a predetermined tension on said spliced web.

5. Apparatus as defined in claim 4, and further wherein said control means is operable to control the tension regulating means (42) of the entire splicing system corresponding to the conveying speed of said vacuum bar member and the working speed of the splicing station.

6. Apparatus as defined in claim 4, and further including web guide means (162) cooperating with said tensioning means (160) to guide the spliced web along a generally S-shaped course, said tensioning means and said web guide means having relatively large radii of curvature, thereby to avoid damage to the flutes of the corrugated layer.

7. Apparatus for splicing together a plurality of successive coplanar single facer corrugated paperboard sections (70) to form a continuous spliced corrugated web (2) having longitudinally extending flutes, each of said sections including rectangular planar upper and corrugated lower layers (70*a*, 70*b*) having corresponding length and width dimensions, respectively, the planar layer of each section being slightly offset relative to said corrugated layer in the direction of the flutes thereof, whereby portions of the planar and corrugated layers protrude at the rearward and forward ends of the sections, respectively, said sections being arranged with their flutes extending in parallel longitudinal alignment, respectively, comprising (a) a frame;

(b) means for transporting the spliced web (2) longitudinally of the frame at a given linear velocity;

(c) means for supplying a plurality of said sections to a first position on said frame adjacent the trailing end of said spliced web, said section supplying means including (1) single facer corrugator means (28; 50) for supplying a fibrous first web (2') longitudinally of said frame, said first web having planar upper and corrugated lower layers (2*a'*, 2*b'*), respectively, the flutes of the lower layer extending tranversely of the web and the planar upper layer being slightly laterally offset relative to the lower layer, whereby portions of the layers protrude relative to each other at opposite longitudinal edges of the web, said first web being supplied longitudinally of the frame;

(2) deflecting means for progressively turning said first web through an angle of 90°, said deflecting means including a stationary web-deflecting roll member (54) arranged at an angle of 45° relative to the initial path of travel of said first web, said first web being progressively guided around said deflecting member to direct said first web laterally outwardly relative to said frame, whereby the flutes of the turned portion of the first web extend parallel with the initial direction of travel of said first web;

(3) severing means (32) arranged laterally outwardly of said frame for severing the turned portion of said first web into successive sections (70) the flutes of which extend parallel with the initial direction of travel of said first web;

(4) transverse conveyor means (66, 67) for transporting said severed sections laterally inwardly relative to said frame; and (5) longitudinal conveyor means (74) arranged longitudinally of said frame for receiving the severed sections from said transverse conveyor means and for transporting the sections longitudinally toward said first position, whereby the sections (70) are arranged on said longitudinal conveyor means with the flutes extending longitudinally in the direction of the conveyance;

(d) means for accelerating successive sections (70) from said first position toward a splicing position in which the protruding corrugated layer portion (70*b*) at the forward end of the section is in generally underlying relation relative to the protruding planar layer portion (2*a*) at the trailing edge of the spliced web, the flutes of said protruding corrugated layer portion being in flute-enmeshing engagement with the adjacent corrguated layer portion (2*b*) of said spliced web; and (e) upper and lower splicer roller means (140,142) for bonding the trailing portion of the spliced web with the leading portion of the section.

8. Apparatus as defined in claim 7, wherein said severing means includes a rotary cutter (32) spaced laterally of said deflecting means, the axis of rotation of said cutter extending parallel with the original direction of feed of said first web, and further including upper diverter means (54) for directing the turned web emitted from said deflecting means to said rotary cutter, and lower diverter means (65) for directing the severed sections upon said transverse conveyor means (66, 67).

9. Apparatus as defined in claim 8, and further including means for disabling said lower diverter means (65), whereby faulty sections produced by said cutter may be discharged from the conveyor system at a location in advance of said transverse conveyor means.

10. Apparatus as defined in claim 8, and further including means for guiding and temporarily supporting the sections (70) during the transport thereof from said transverse conveyor means (66, 67) to said longitudinal conveyor means (74), said guide means including a pair of parallel longitudinally spaced rotary guide members (68) arranged beneath said deflecting means with their axes extending transversely relative to, and in a plane elevated above, said longitudinal conveyor means, said rotary members containing longitudinal through slots and being spaced to receive the front and rear edge portions of successive severed sections (70) discharged from said transverse conveyor means (66, 67), and stepping drive means (69) for rotating said rotary guide members in opposite directions in a stepped manner, the stepped rotation of said guide means being so timed as to deposit on said longitudinal conveyor means a severed section that has been transported to a position above said longitudinal conveyor means.

11. Apparatus as defined in claim 10, wherein each of said rotary guide members includes a central shaft (**68*b*), a plurality of circumferentially spaced rods (68*a*) arranged around said central shaft, and a plurality of radial arms (68*c***) connecting said rods to said shaft.

12. Apparatus as defined in claim 11, wherein a plurality of pairs of rods of each of said rotary guide members cooperate to define the slots for receiving the corresponding edge portions of the severed sections.

13. Apparatus as defined in claim 10, wherein the feed of the severed sections (70) and the time stepped operation of said rotary guide members (68) by said stepping drive means (69) is such relative to the speed of said longitudinal conveyor means (74) as to cause the edge portions of successive sections deposited on said longitudinal conveyor means to overlap.

14. Apparatus as defined in claim 7, and further including means for stacking at a stacking station (34) the severed sections (70) delivered by said longitudinal conveyor means, said stacking means including an endless stacking conveyor (80) arranged in longitudinal alignment with said longitudinal conveyor means for receiving the sections transported thereby, said stacking conveyor being mounted for pivotable movement at its rear end about a horizontal pivot axis extending transversely to the direction of feed, and means (82) for progressively elevating the forward end of said stacking conveyor during the formation of a vertical stack (90) of said severed sections.

15. Apparatus as defined in claim 14; and further including a stack support (83) upon which the sections are stacked, said stack support being pivotable about an axis parallel with the axis of pivotal movement of said stacking conveyor, and means (86) for progressively pivoting said stack support in the opposite direction than said stacking conveyor during the formation of a stack (90).

16. Apparatus as defined in claim 15, and further including drive motor means (88) operable when the stack support (83) is in the horizontal position for displacing a stack (90) of sections thereon longitudinally toward said vacuum bar means.

17. Apparatus as defined in claim 14, and further including means including a stop (121) supporting the stack at a splicing position in which the forward edge portion of the lowermost section of the stack is above said vacuum bar member (120) when the vacuum bar is in its rearmost retracted position, presser means (114) biasing the forward edge portions of the stacked sections downwardly toward said vacuum bar, said control valve means being operable to apply vacuum during the forward movement of said vacuum bar, whereby the lowermost section of the stack is transported toward said spliced web by said vacuum bar member.

18. Apparatus as defined in claim 17, wherein said stack support means includes a plurality of support rollers (112) having profiles corresponding with the flutes of corrugated layer.

19. Apparatus as defined in claim 17, and further including means for supplying successive sections to the top of said stack at said splicing position, said supply means including a pair of parallel inlet guide rollers (102, 103) arranged adjacent the top of the stack, said rollers being separable to avoid contact with the forward portions of successive sections, thereby to avoid contact with adhesive carried thereby.

20. Apparatus as defined in claim 19, and further wherein said guide rollers include end rollers (107) for supporting the ends of successive sections in slightly elevated relation relative to the center portions of the sections.

21. Apparatus as defined in claim 19, and further including means including a vacuum element (100) mounted for longitudinal horizontal reciprocation relative to said guide rollers (102, 103) for feeding the uppermost section of a further stack of said sections, said vacuum element being operable to lift the uppermost section over a fixed stop (101) that positions said further stack relative to said guide rollers.

22. Apparatus as defined in claim 21, and further including means (106) for elevating said further stack relative to said guide rollers (102, 103).

* * * * *